US007481174B2

(12) United States Patent
Atkinson

(10) Patent No.: US 7,481,174 B2
(45) Date of Patent: Jan. 27, 2009

(54) ROTATABLE GUARD MOUNTED ABOUT BOAT MOORING

(75) Inventor: Darin Atkinson, Miami, OK (US)

(73) Assignee: Boat Guard International, Inc., Miami, OK (US)

( * ) Notice: Subject to any disclaimer, the term of this patent is extended or adjusted under 35 U.S.C. 154(b) by 0 days.

(21) Appl. No.: 11/671,157

(22) Filed: Feb. 5, 2007

(65) Prior Publication Data

US 2008/0184924 A1 Aug. 7, 2008

(51) Int. Cl.
*B63B 21/00* (2006.01)
*B63B 59/02* (2006.01)

(52) U.S. Cl. ..... 114/230.13; 114/220

(58) Field of Classification Search ..... 114/219
See application file for complete search history.

(56) References Cited

U.S. PATENT DOCUMENTS

| | | | | |
|---|---|---|---|---|
| 799,645 | A | | 9/1905 | Grimm |
| 2,420,677 | A | | 5/1947 | Peterson |
| 2,652,694 | A | | 9/1953 | Melges |
| 2,754,792 | A | | 7/1956 | Baird |
| 3,084,517 | A | | 4/1963 | Bell |
| 3,145,685 | A | | 8/1964 | Kulick, Sr. |
| 3,151,595 | A | | 10/1964 | Stainbrook |
| 3,177,839 | A | | 4/1965 | Nolf |
| 3,336,896 | A | | 8/1967 | Burnett |
| 4,227,832 | A | | 10/1980 | Leone et al. |
| 4,679,517 | A | | 7/1987 | Kramer |
| 4,804,296 | A | | 2/1989 | Smath |
| 4,920,907 | A | | 5/1990 | Richter |
| 5,113,702 | A | * | 5/1992 | Capps ..... 114/219 |
| 5,184,562 | A | * | 2/1993 | Hallin ..... 114/219 |
| 5,775,353 | A | * | 7/1998 | Johnson ..... 135/96 |
| 5,911,189 | A | | 6/1999 | Ryan |
| 6,112,690 | A | | 9/2000 | Anderson |
| 6,406,221 | B1 | | 6/2002 | Collier |
| 6,513,449 | B1 | | 2/2003 | Stewart et al. |
| 6,601,530 | B2 | | 8/2003 | Barmakian et al. |
| 7,237,502 | B1 | | 7/2007 | Atkinson |
| 2006/0130727 | A1 | | 6/2006 | Eischeid |

* cited by examiner

*Primary Examiner*—Jesus D Sotelo
(74) *Attorney, Agent, or Firm*—Hovey Williams LLP

(57) ABSTRACT

Improved boat bumper assemblies are provided which include upright, rotatable, synthetic resin rollers rotatably mounted on stationary uprights located adjacent the sides of a boat slip. In one form, the bumper assemblies are mounted either as original equipment or as retrofits directly onto roof-supporting stanchions of a boat mooring structure; alternately, standoff bumper assemblies may be used, having rollers rotatable on uprights and supported by spring-biased, resilient connection structures.

43 Claims, 9 Drawing Sheets

ROTATABLE GUARD MOUNTED ABOUT BOAT MOORING

BACKGROUND OF THE INVENTION

1. Field of the Invention

The present invention is broadly concerned with improved boat bumper assemblies used in boat mooring, boat storage, and boat transportation devices in order to minimize the possibility of boat damage during boat dockage and storage. More particularly, embodiments of the present invention are concerned with such improved boat bumper assemblies which can form a part of an original mooring construction, or can be installed as a retrofit to existing units.

2. Discussion of Prior Art

Cushioning bumper assemblies used in units for storing, supporting, or securing boats are known in the art. Such bumpers may be found on boat trailers and on docks or slips to prevent damage in the event that boats come into contact with the adjacent dock or slip structure during the course of boat docking or during severe weather conditions. Such prior bumpers have included stationary resilient devices and roller assemblies, such as horizontally disposed rollers or vertically oriented rollers.

Prior art boat bumpers are deficient in a number of important respects. First and foremost, they often do not provide adequate cushioning when engaged by a boat, especially during high wind and wave conditions or when relatively high-speed docking is attempted. Horizontally oriented roller-type bumpers may be difficult to see and can thus inhibit safe docking. In addition, prior roller bumpers are generally not capable of being retrofitted to existing docks or the like.

SUMMARY OF THE INVENTION

In accordance with these and other objects evident from the following description of the preferred embodiment, a first aspect of the present invention concerns a boat mooring assembly broadly including a frame, a plurality of upright stanchions, a roof structure, and a boat bumper. The frame includes a side section that defines a boat slip. The plurality of upright stanchions are spaced along the length of the side section. The roof structure is supported by the stanchions. The boat bumper is mounted on one of the stanchions. The boat bumper includes an elongated roller that surrounds and is rotatable about the one of the stanchions.

A second aspect of the present invention concerns a retrofit boat bumper operable to be mounted on an upright of a boat mooring assembly. The bumper broadly includes a pair of end bearings and a roller. The pair of end bearings is operable to be mounted on the upright at spaced apart locations. The end bearings include a plurality of mated end bearing components. The roller is rotatably mounted on the end bearings and is thereby configured to surround and rotate about the upright. The roller includes a plurality of mated roller sections.

A third aspect of the present invention concerns a boat bumper assembly operable to be used on a boat mooring assembly, wherein the boat mooring assembly includes a frame with a side section that defines a boat slip. The boat mooring assembly further includes a plurality of uprights spaced along the length of said side section, wherein the boat bumper assembly is operable to be mounted on one of said uprights. The boat bumper assembly broadly includes an upright support member, a pair of end bearings, a roller, and a cushioning connector. The pair of end bearings is mounted on the member at spaced apart locations. Each of the end bearings includes a plurality of mated end bearing components. The roller is rotatably mounted on the end bearings. The roller includes a plurality of mated roller sections. The cushioning connector is operable to secure the support member to a corresponding upright.

A fourth aspect of the present invention concerns a boat bumper assembly operable to be used on a boat mooring assembly, wherein the boat mooring assembly includes a frame with a side section that defines a boat slip. The boat mooring assembly further includes a plurality of uprights spaced along the length of said side section, wherein the boat bumper assembly is operable to be mounted on one of said uprights. The boat bumper assembly broadly includes an upright support member, a pair of end bearings, a roller, and a cushioning connector. The pair of end bearings is fixed to the member at spaced apart locations with journal bearing surfaces spaced from the member. The roller is rotatably received on the journal bearing surfaces. The roller surrounds and is rotatable about the member and the pair of end bearings. The cushioning connector is operable to secure the support member to a corresponding upright.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
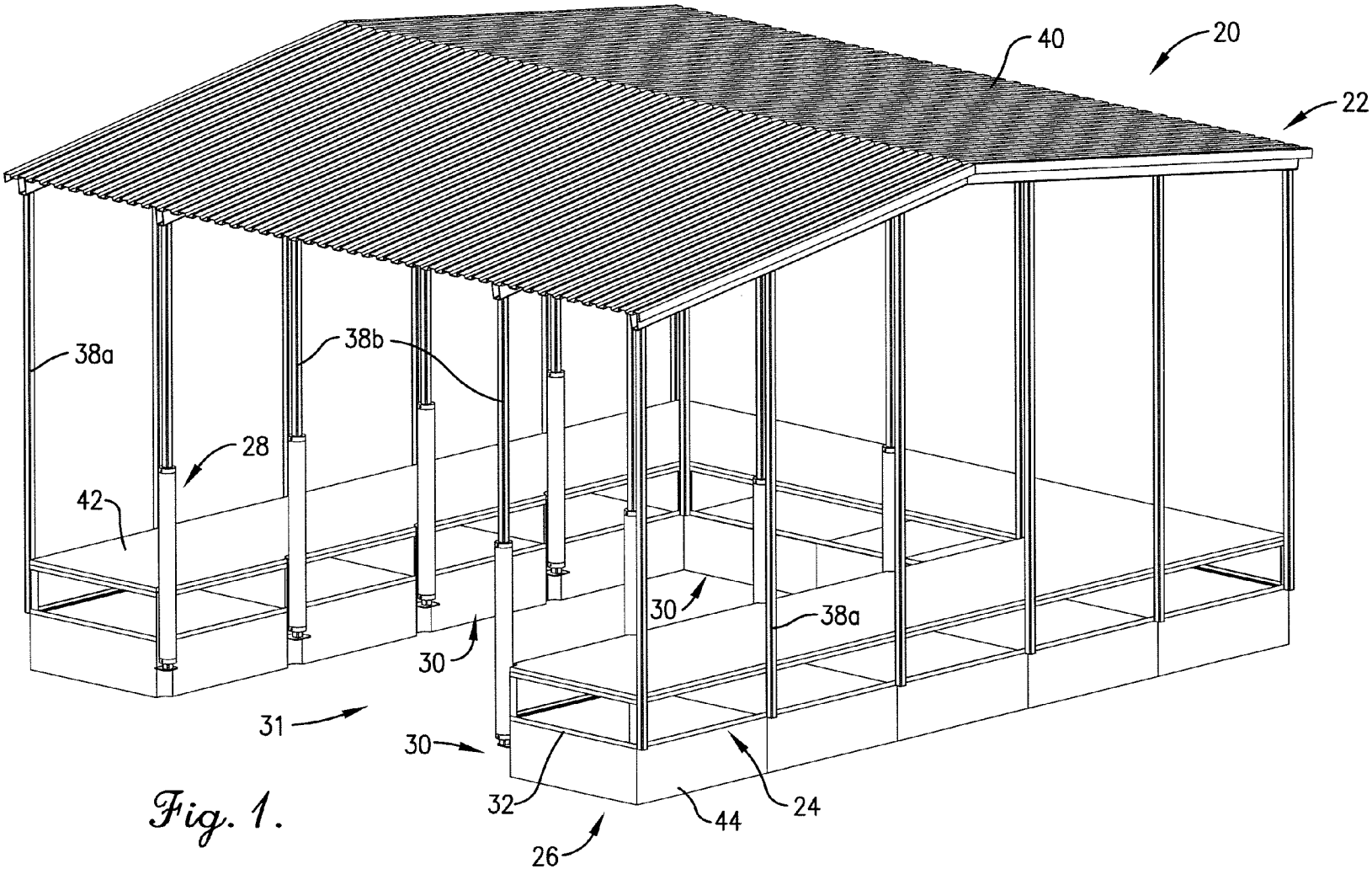
FIG. 1 is a perspective view of a boat mooring assembly constructed in accordance with a preferred embodiment of the present invention, having preferred upright rotatable boat bumpers.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a boat mooring 20 is illustrated in the form of a covered, floating dock 22 of generally U-shaped configuration. The dock 22 broadly includes a metallic frame 24, a buoyant foundation 26 that supports the frame 24, and boat bumper assemblies 28. While the illustrated bumper assemblies 28 are principally shown in use with a stationary boat mooring, the principles of the present invention are equally applicable where the bumper assemblies 28 are used generally with boat securement structures, including boat-hauling trailers (not shown). Additional details concerning other preferred boat securements are disclosed in copending U.S. application Ser. No. 11/307,124, filed Jan. 24, 2006, entitled BOAT BUMPER, which is hereby incorporated by reference herein.

As will be described further, the dock 22 presents integral side sections 30 that cooperatively define a boat slip 31 and the bumper assemblies 28 are positioned along the side sections 30 to prevent or at least minimize damage to a boat within slip 31. In particular, the illustrated slip 31 is rectangular and includes a front adjacent to the dock entry, sides, and back. While the illustrated dock 22 is rectangular in shape and surrounds three sides of the slip 31, the principles of the present invention are equally applicable to alternative dock shapes that may define alternative slip shapes or surround a slip to a lesser or greater extent. In other words, the slip 31 is generally a berth where a boat is made fast. Additional details concerning other preferred features of the dock 22 and slip 31 are disclosed the above-referenced copending U.S. Application.

Turning to FIGS. 1-4, the frame 24 includes a series of lower horizontal metallic frame members 32 positioned atop foundation 26, as well as upright, concavo-convex metallic plates 34 having lowermost lateral segments 35 which are secured to the frame members 32 and extend upwardly therefrom. The plates 34 each preferably provide a substantially semi-circular recessed location of the frame 24, as will be discussed. However, it is consistent with the principles of the present invention where the frame 24 presents sides without the recessed locations or alternatively shaped recessed locations.

A series of upper frame members 36 are also provided, which are secured to the plates 34 and are also connected to the lower frame members 32 by stabilizing struts (not shown). The overall frame 24 further includes a series of spaced apart, upright, square tubular, metallic stanchions 38*a*, 38*b* secured to the frame members 32 and 36. The outboard stanchions 38*a* are preferably welded directly to the frame components 32 and 36, whereas the inboard stanchions 38*b* are secured to the lower segments 35 of the plates 34, with the stanchions 38*b* being preferably received adjacent a concave side of the plate 34. However, it is within the ambit of the present invention where the stanchions 38*a*, 38*b* are fixed to alternative features of the frame 24. Furthermore, the principles of the present invention are applicable where the stanchions 38*a*, 38*b* are alternatively attached to the frame 24, e.g., with threaded fasteners. As shown, the stanchions 38*a*, 38*b* support an upper gabled roof 40 which overlies slip 31. The frame 24 also supports a generally U-shaped deck 42 forming a walkway which is disposed about slip 31 and is supported vertically by the upper frame members 36.

In the illustrated embodiment, the foundation 26 is in the form of a series of discrete, buoyant, synthetic resin foam blocks placed in abutting contact with one another and secured to the lower frame members 32. The principles of the present invention are equally applicable where other types of buoyant structures are incorporated into dock 22.

Figure 2:
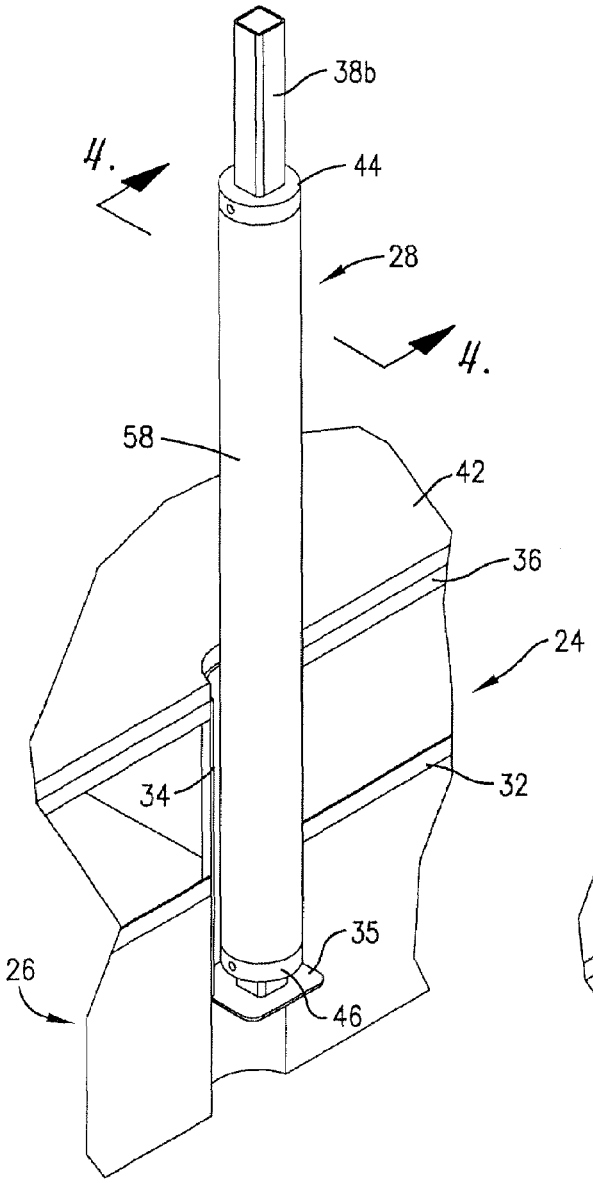
FIG. 2 is a fragmentary perspective view of the boat mooring assembly shown in FIG. 1, illustrating one of the rotatable boat bumpers.
Figure 3:
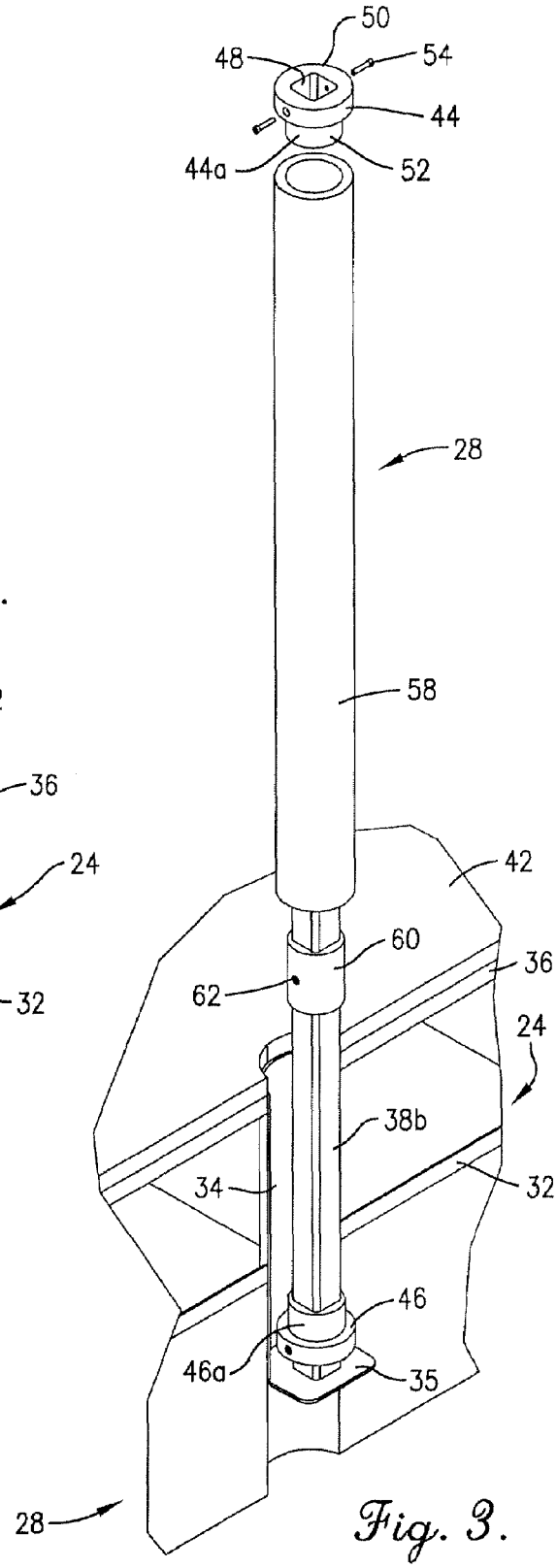
FIG. 3 is a fragmentary, perspective view of the boat mooring assembly shown in FIGS. 1 and 2, showing the rotatable boat bumper exploded from a corresponding upright of the boat mooring assembly.

The bumper assemblies 28 are mounted on the inboard stanchions 38*b* which are located along the laterally spaced apart side sections 30. Each of the assemblies 28 includes a pair of upper and lower end bearings 44 and 46 which are secured to a corresponding stanchion 38*b*. As best illustrated in FIGS. 2 and 3, the end bearings 44, 46 have a square central passageway 48 complemental with the stanchion 38*b*, allowing the bearings to be positioned at desired locations on the stanchion 38*b* while preventing relative rotational movement therebetween. While the illustrated bearings 44,46 are preferably centered relative to the corresponding stanchion 38*b*, it is within the ambit of the present invention where the bearings 44,46 are axially offset. In addition, each of the end bearing 44, 46 has an apertured flange section 50 as well as an inner, tubular projection 52. The end bearings 44,46 each preferably include journal bearing surfaces 44*a*, 46*a*. While the illustrated end bearings 44,46 are preferably journal bearings and, more preferably, are substantially unitary, it is also within the ambit of the present invention where ball bearings, roller bearings, or other types of bearings serve as end bearings 44,46 A pair of threaded fasteners 54 extend through each flange section 50 and into threaded openings 56 provided in stanchion 38b, thereby securing the end bearings 44,46 to the latter.

Figure 4:
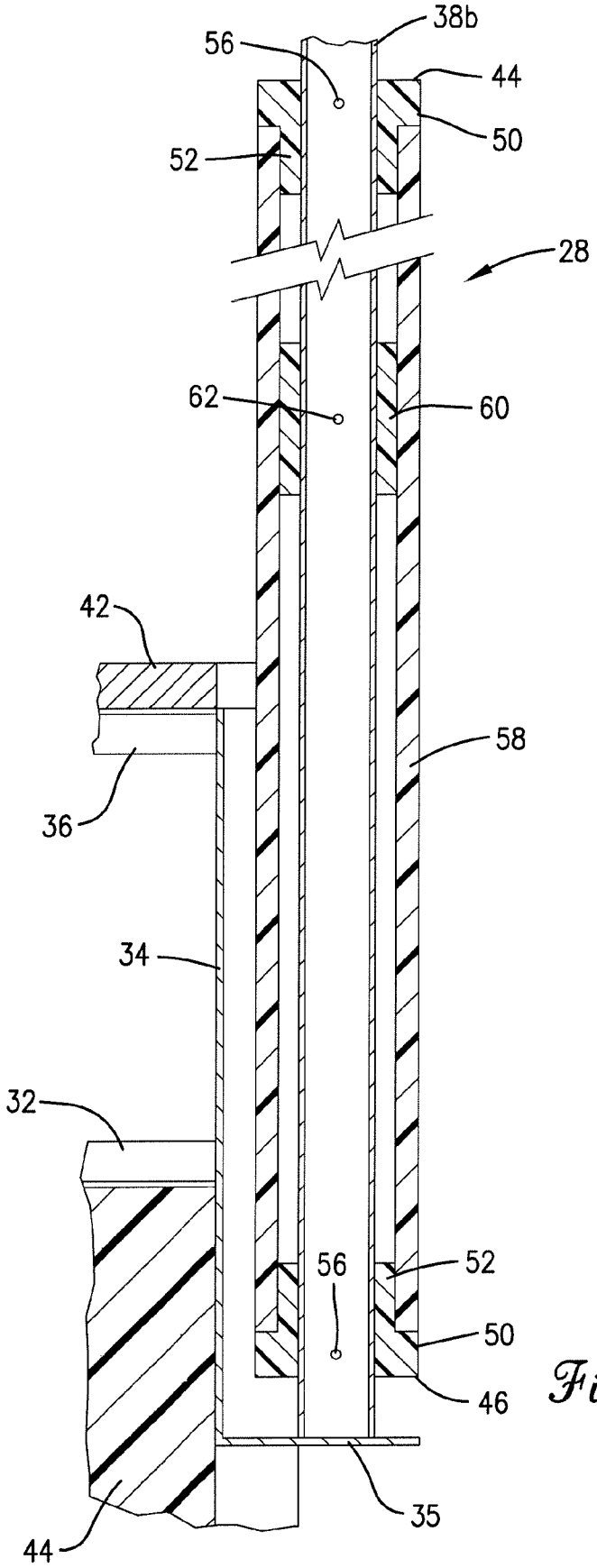
FIG. 4 is a sectional view taken along line 4-4 of FIG. 3 and illustrating the internal construction of the rotatable boat bumper.

Turning to FIGS. 2-4, each assembly 28 also preferably has an elongated, synthetic resin, tubular roller 58 which is slidably supported by the end bearings 44, 46. As illustrated in FIG. 4, the opposed ends of the roller 58 receive the end bearing projection 52, and butt against the flange sections 50. In this fashion, the roller ends are slidably received by the respective bearing surfaces 44*a*, 46*a* and the roller 58 is rotatable about the longitudinal axis of the stanchion 38*b*. Sliding contact between the roller ends and end bearings 44,46 preferably involves contact substantially along the circumference of the respective roller ends. However, the principles of the present invention are applicable where contact between the roller ends and end bearings 44,46 occurs along a part of the circumference of the roller ends. Also, while the illustrated roller 58 are preferably centered relative to the stanchion 38*b*, it is within the ambit of the present invention where the roller 58 is axially offset with respect to stanchion 38*b*. The illustrated assembly 28 preferably has the roller 58 positioned partly within the recessed location defined by the plates 34 as discussed above. However, it is consistent with the principles of the present invention where the rollers 58 are alternatively positioned relative to the frame 24.

The illustrated assembly 28 also preferably includes an intermediate tubular bearing 60 which is secured to stanchion 38*a* at a point between the end bearings 44, 46. The bearing 60 also has a square central passageway and, similar to the end bearings 44,46, an outer surface designed to engage and support the inner surface of the roller 58. The bearing 60 is secured to stanchion 38*b* by means of fasteners 62 extending through the bearing and into stanchion 38*b*. The principles of the present invention are also applicable where the assembly 28 includes either no intermediate tubular bearing 60, or a plurality of the tubular bearings 60.

Figure 5:
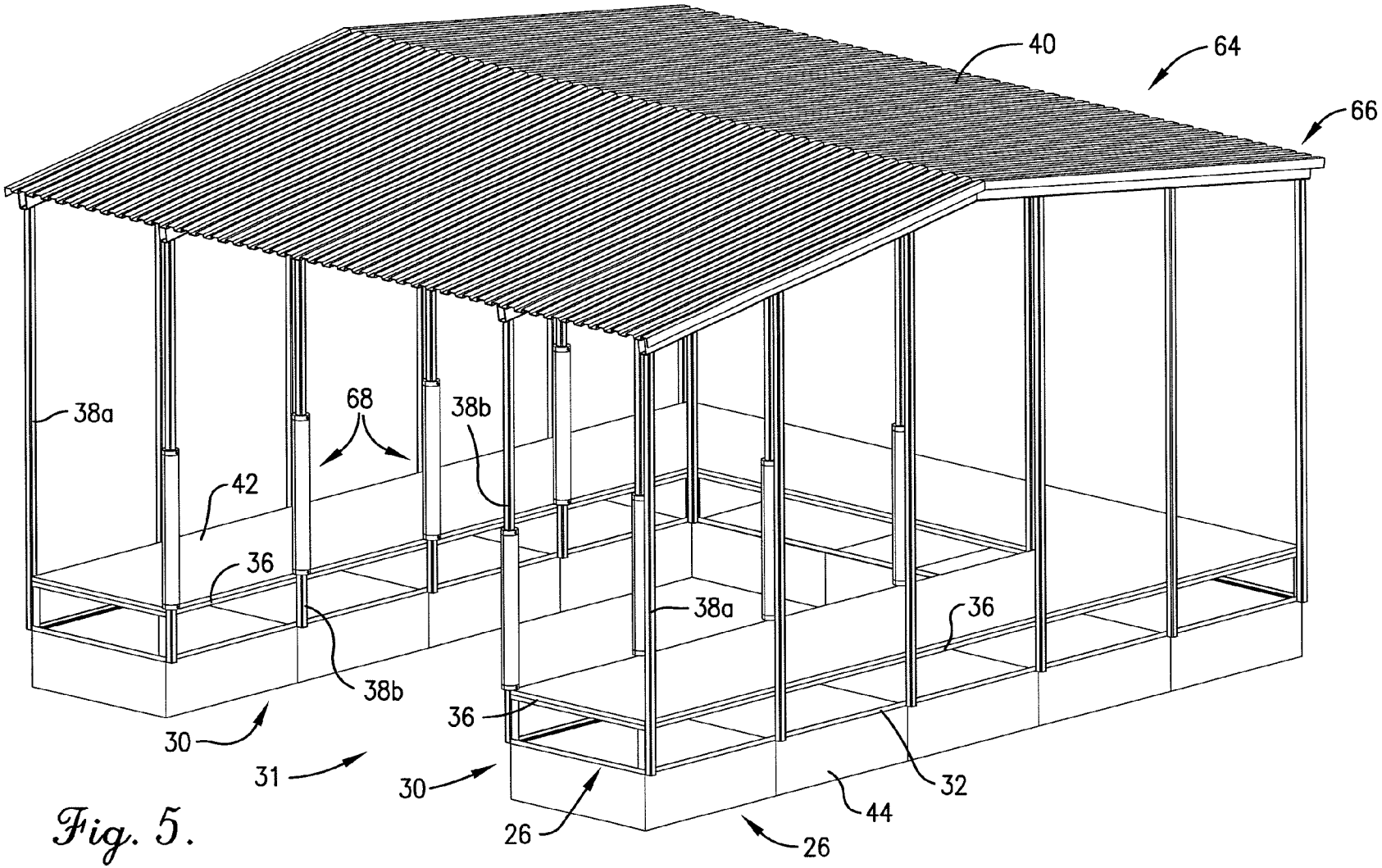
FIG. 5 is a perspective view of a boat mooring assembly constructed in accordance with a first alternative embodiment of the present invention, having retrofitted upright rotatable boat bumpers.
Figure 6:
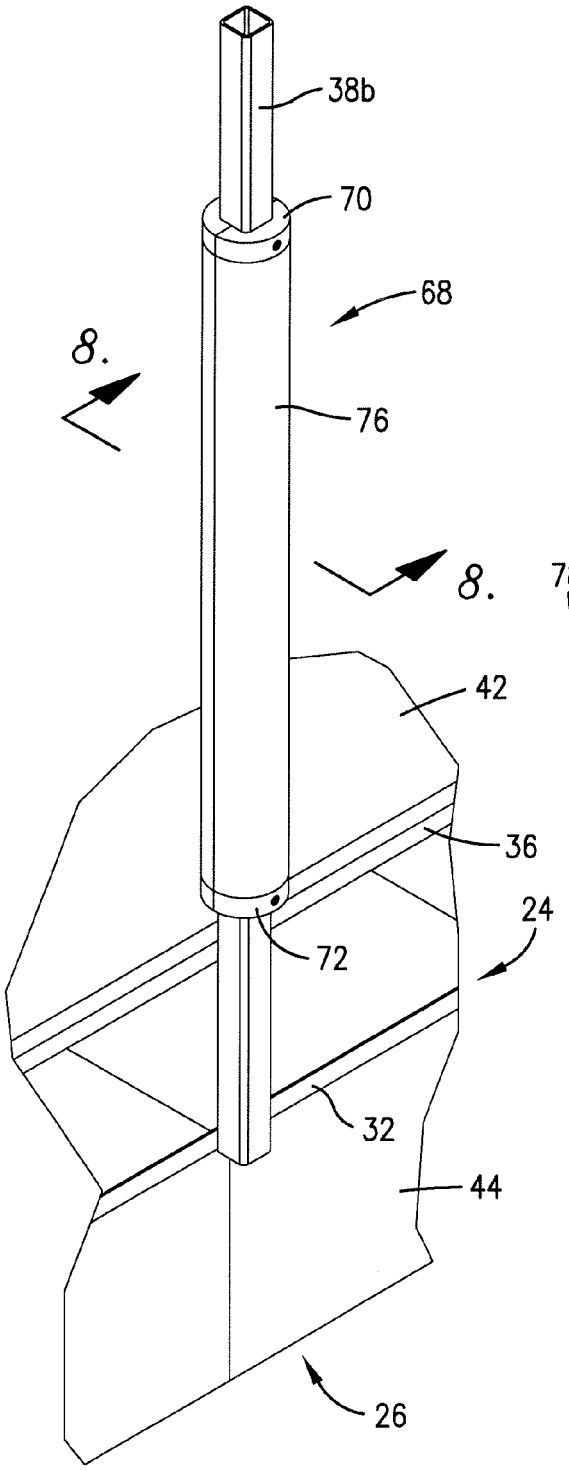
FIG. 6 is a fragmentary perspective view of the boat mooring assembly shown in FIG. 5, illustrating one of the retrofitted boat bumpers.
Figure 7:
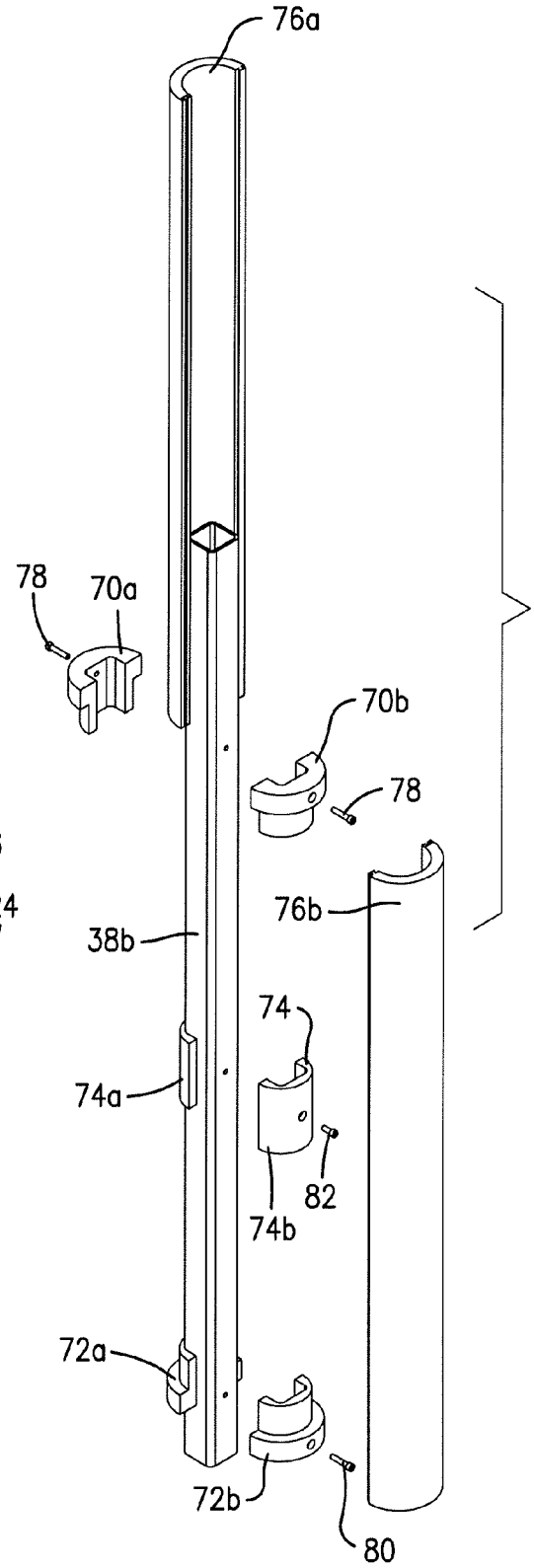
FIG. 7 is a fragmentary, perspective view of the boat mooring assembly shown in FIGS. 5 and 6, showing the components of the retrofitted boat bumper exploded from a corresponding upright of the boat mooring assembly.
Figure 8:
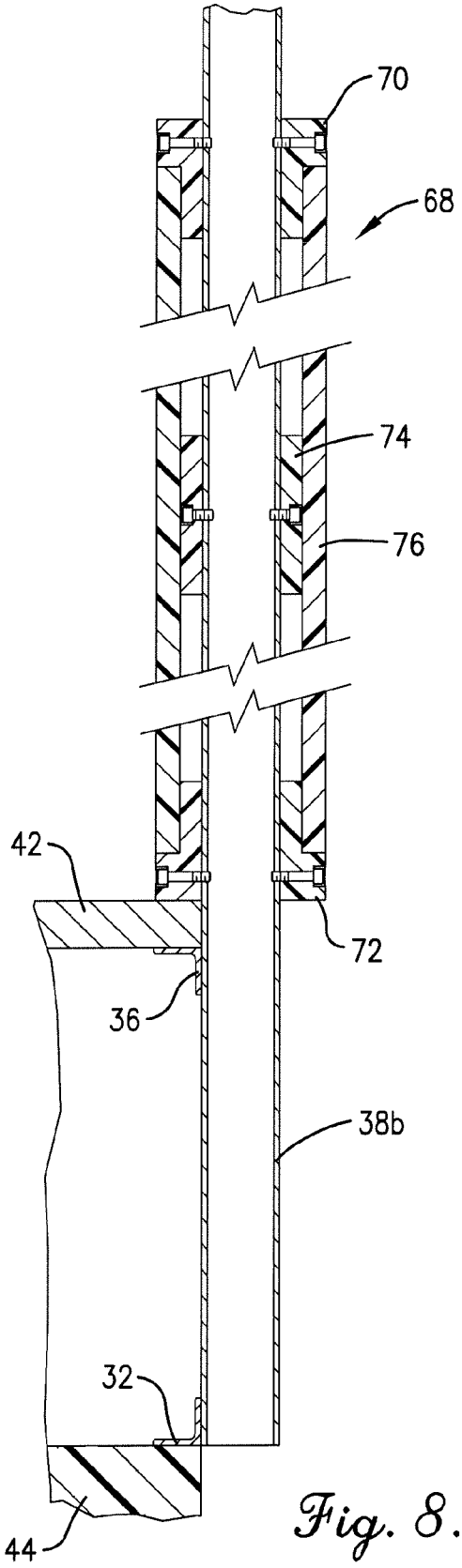
FIG. 8 is a sectional view taken along line 8-8 of FIG. 6 and illustrating the internal construction of the retrofitted boat bumper.
Figure 9:
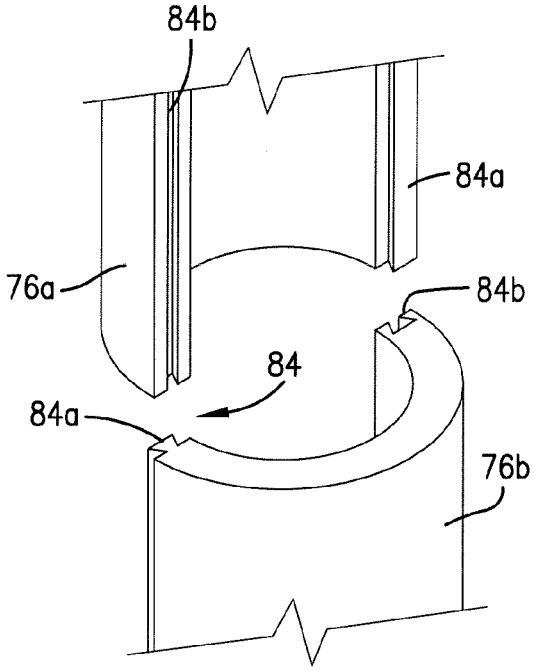
FIG. 9 is a fragmentary, perspective, exploded view of the retrofitted boat bumper illustrating roller sections with complemental dovetail ends.

Turning to FIGS. 5-10, an alternative boat mooring 64 is illustrated in the form of an alternative floating dock 66 having many of the same components as assembly 20. Accordingly, like reference numerals are used to identify identical components, and principally the differences between the two embodiments will be described in detail. Specifically, the inboard stanchions 38*b* in FIG. 5 are identical to the outboard stanchions 38*a* in that they are directly welded to the frame members 32 and 36, without the use of the plates 34. Also, the FIG. 5 embodiment employs alternative boat bumper assemblies 68 which can be applied to the stanchions 38*b* preferably as retrofits. However, the principles of the present invention are equally applicable where the boat bumper assemblies are provided as original equipment on dock 66.

Each assembly 68 includes upper and lower end bearings 70 and 72, optional intermediate bearing 74, and roller 76. However, in order to permit retrofitting of the assembly 68, these components are each provided in the form of a plurality of mated components which collectively present the end bearings 70, 72, intermediate bearings 74, and roller 76.

Specifically, the upper end bearing 70 is made up of two halves 70*a* and 70*b;* lower end bearing 72 is composed of halves 72*a* and 72*b;* intermediate bearing 74 is made up of halves 74*a* and 74*b;* and roller 76 comprises halves 76*a* and 76*b*. While the illustrated bearings 70,72,74 and roller 76 are comprised of two identical halves, it is also within the ambit of the present invention where the bearings 70,72,74, and roller 76 are comprised of more than two portions or of alternatively-sized portions.

Figure 10:
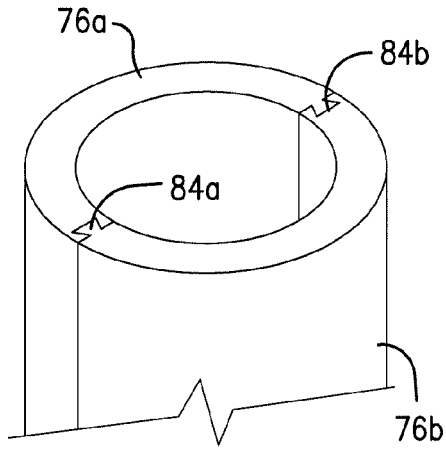
FIG. 10 is a fragmentary perspective view illustrating the interfitted roller halves.
Figure 11:
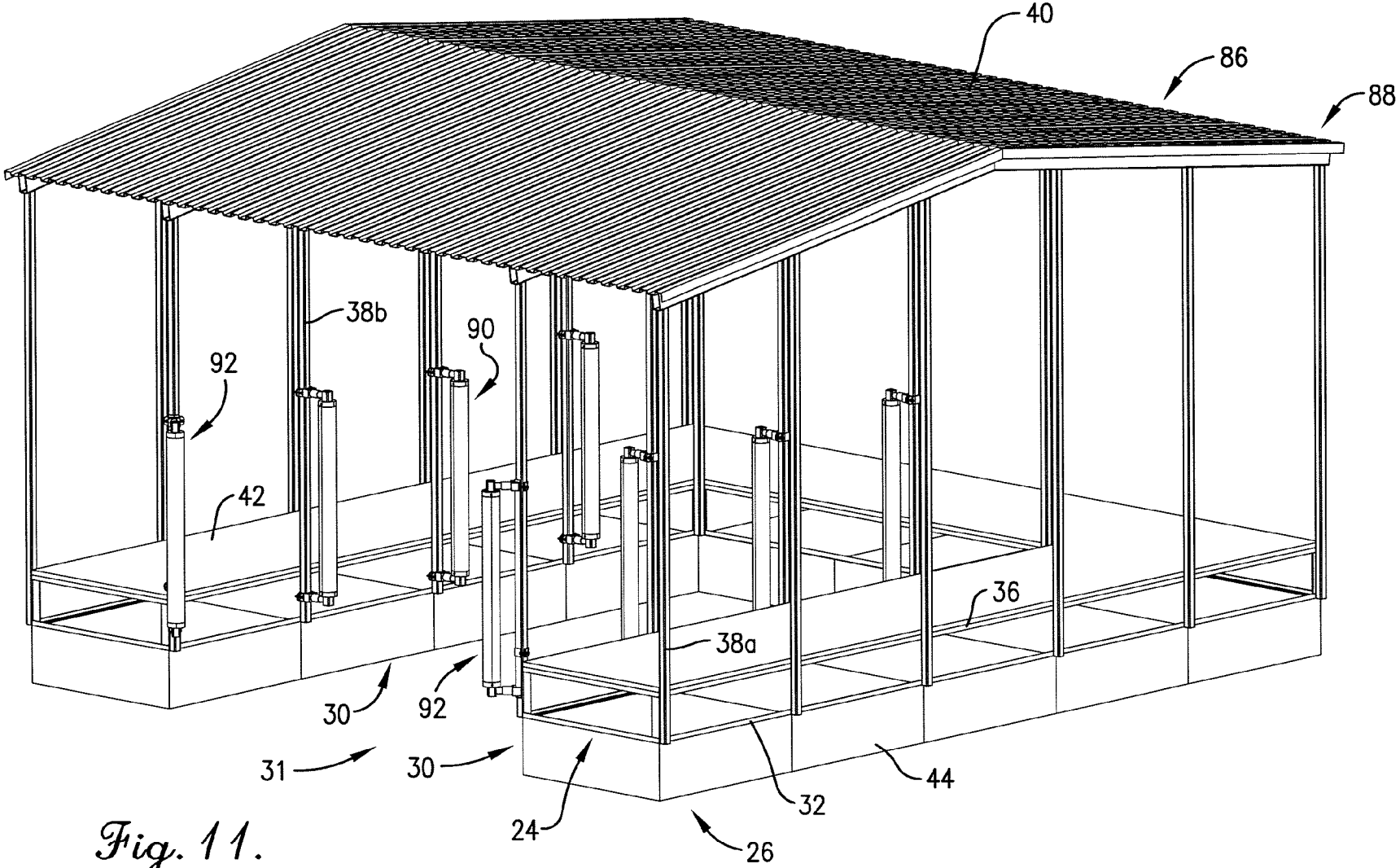
FIG. 11 is a perspective view of a boat mooring assembly constructed in accordance with a second alternative embodiment of the present invention, having standoff-mounted upright boat bumpers.

The bearing halves are secured to stanchion 38*b* by means of threaded fasteners 78, 80, and 82 so that the mated halves cooperatively present complete bearing structures. In the case of roller 76, the halves 76*a* and 76*b* have endmost, vertically extending dovetail joint structure 84 in the form of a dovetail projection 84*a* and a mating dovetail slot 84*b* on opposite elongated butt edges of each half 76*a,* 76*b*. In this fashion, when the dovetail joint structure 84 is interconnected, a complete tubular roller 76 is provided (FIG. 10). While the illustrated roller 76 preferably includes the dovetail joint structure 84, the principles of the present invention are also applicable where the roller halves 76*a,* 76*b* include an alternative interconnecting structure such as threaded fasteners, adhesively-mated surfaces, or another type of mechanically-interconnecting tabs.

In order to retrofit the assembly 68 onto stanchion 38*b,* the lower end bearing 72 and intermediate bearing 76 are first installed using the fasteners 80 and 82. At this point, one of the roller halves 76*a* or 76*b* is positioned against the previously installed bearings 72 and 74, and the other roller half is then joined with the first half by interfitting the dovetail joint structure 84, and the other roller half is then slid downwardly until it bottoms out against lower end bearing 72. At this point, the upper end bearing is installed by locating the halves 70*a* and 70*b* within the upper end of roller 76, followed by installation of the fasteners 78. Again, the principles of the present invention are applicable where an alternative structure for interconnecting the roller halves 76*a,* 76*b* is used and, therefore, an alternative assembly process is required. For example, the roller halves 76*a,* 76*b* could be attached to one another by relative lateral movement instead of relative axial movement as shown in the illustrated embodiment.

The boat bumper assemblies 28 and 68 of the foregoing embodiments operate in the same fashion. That is, when a boat encounters one of the bumpers, it rotates about the upright axis defined by the corresponding stanchion so as to absorb the engagement load and prevent boat damage. In addition, the bearings 44,46,60,70,72,74 preferably restrict lateral deformation of the corresponding roller 58,76. However, the principles of the present invention are applicable where the assemblies 28,68 permit lateral deformation of the roller 58,76 so that the roller 58,76 absorbs some energy associated with the collision between the boat and bumper.

Turning to FIGS. 11-15, yet another alternative boat mooring 86 in the form of a dock 88 is illustrated which, save for the standoff boat bumper assemblies 90 and 92 thereof, is substantially identical with dock 66. Therefore, like reference numerals are used to identify the components of dock 88, and principally the assemblies 90, 92 will be described in detail. Additional details concerning these standoff-type bumper assemblies 90,92 are described in the above-referenced copending U.S. Application.

Figure 12:
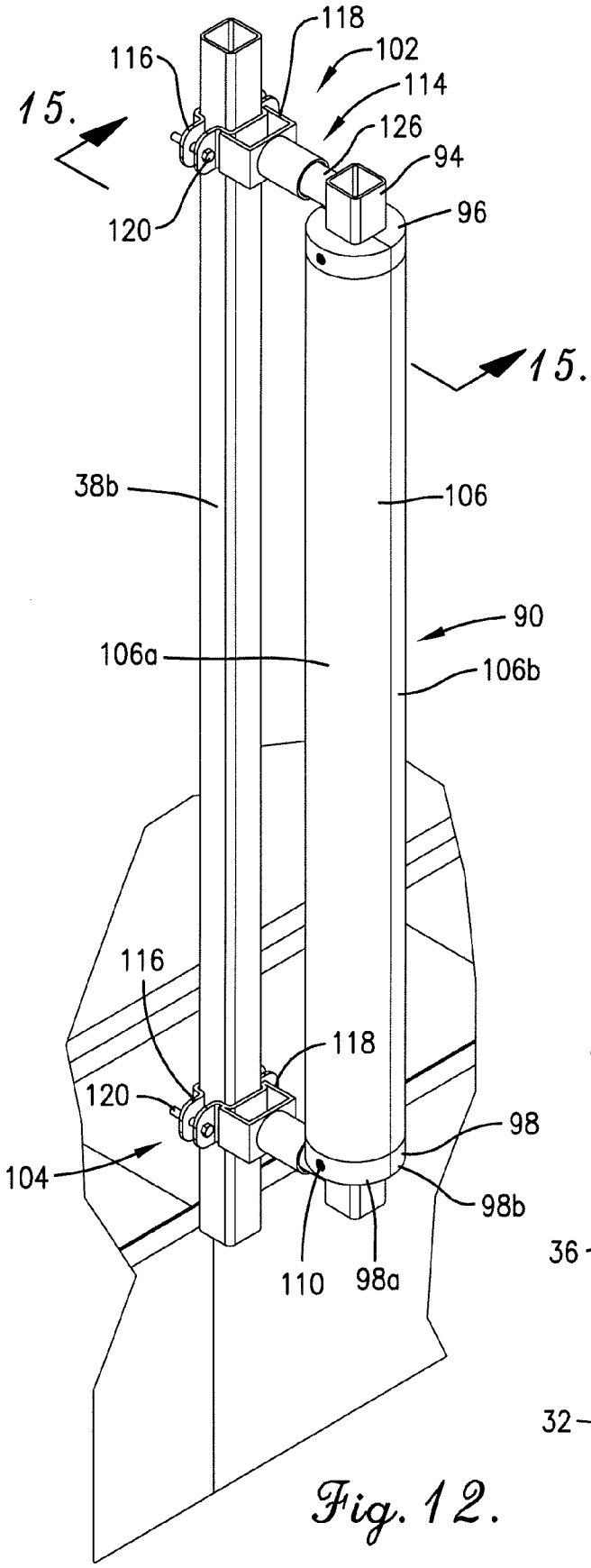
FIG. 12 is a fragmentary perspective view of the boat mooring assembly shown in FIG. 11, illustrating one of the standoff-mounted boat bumpers.
Figure 13:
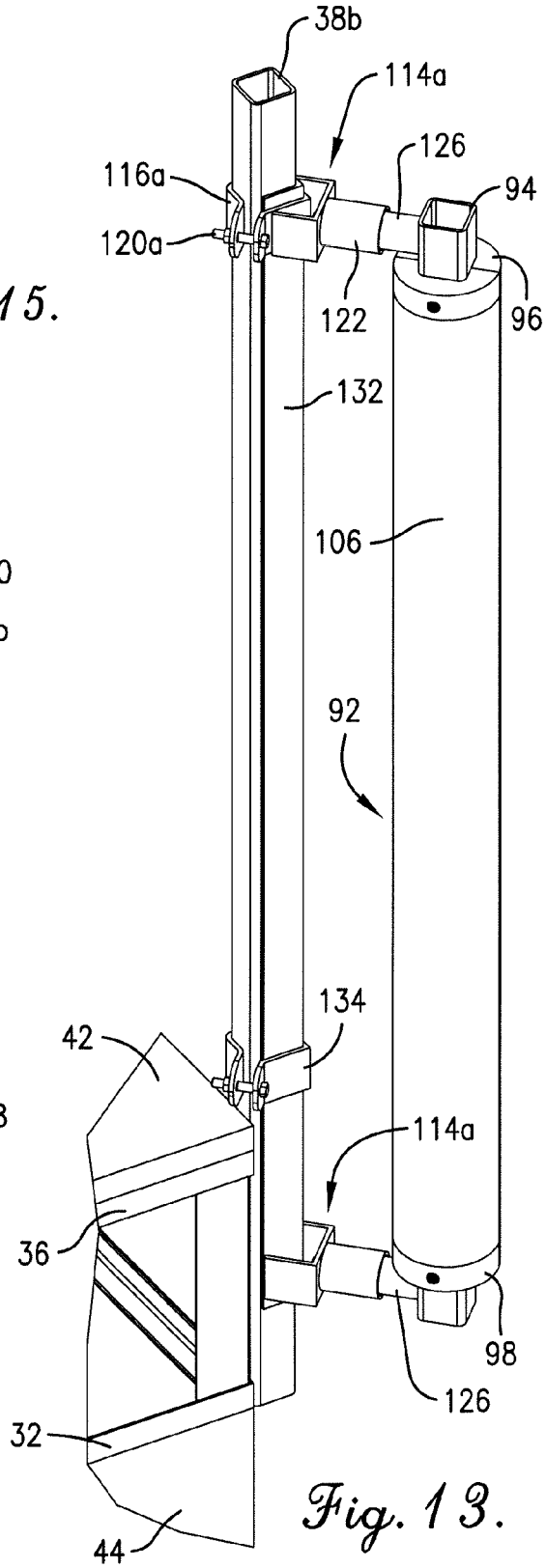
FIG. 13 is a fragmentary perspective view of the boat mooring assembly shown in FIG. 11, illustrating a corner-mounted upright boat bumper.
Figure 14:
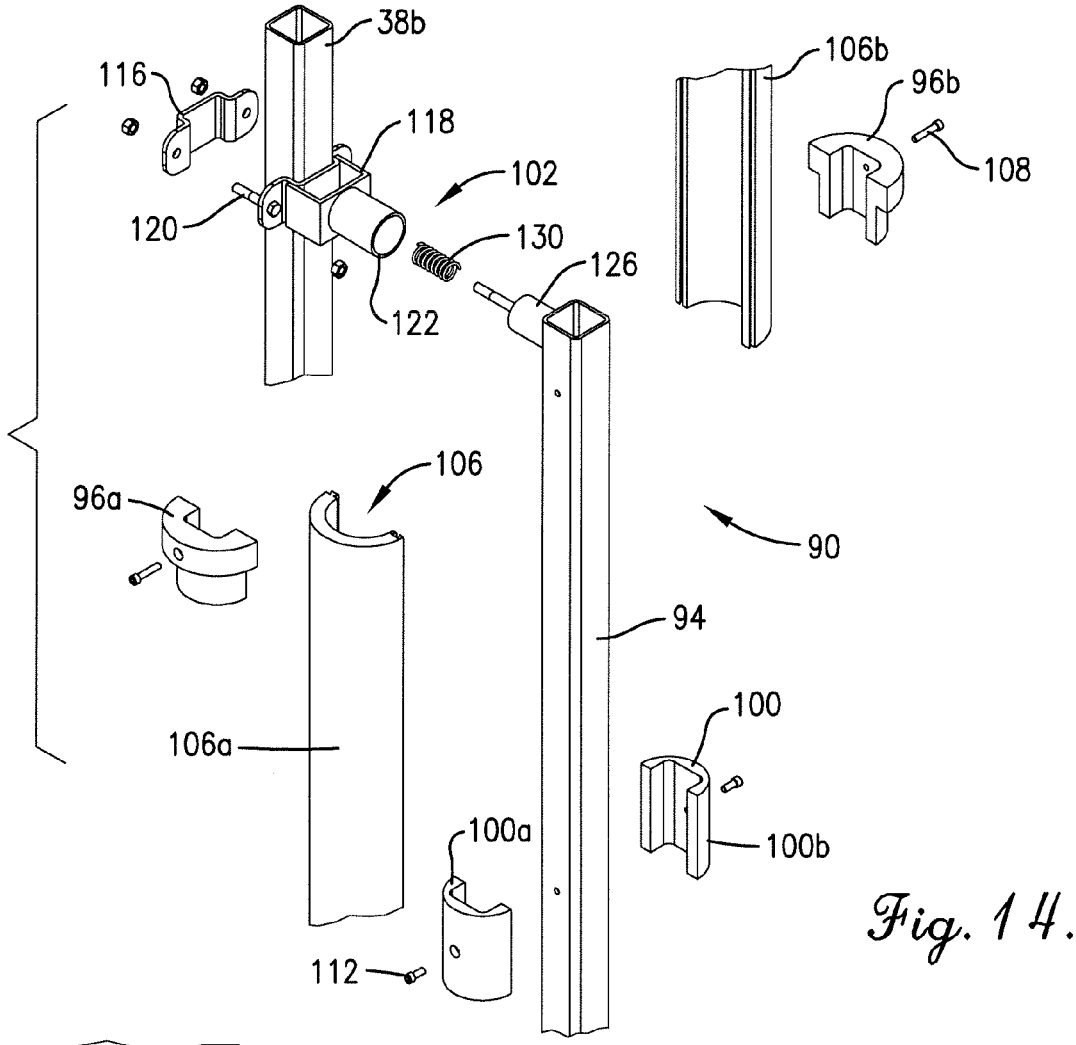
FIG. 14 is a fragmentary perspective exploded view of the standoff-mounted boat bumper shown in FIG. 11.
Figure 15:
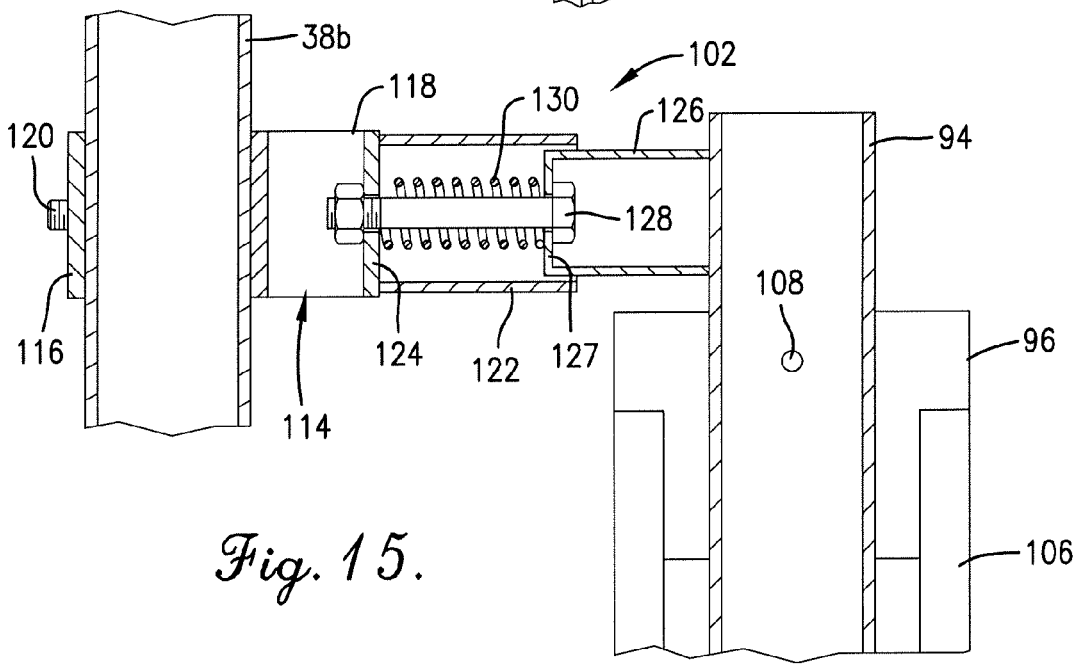
FIG. 15 is a fragmentary, vertical sectional view taken along line 15-15 of FIG. 12.

FIGS. 12 and 14-15 illustrate the construction of the bumper assemblies 90 provided along the length of the sections 30, whereas FIG. 13 depicts a corner bumper assembly 92. Referring first to the assemblies 90, it will be seen that each includes a square tubular metallic upright 94, upper and lower end bearings 96, 98, intermediate bearing 100, upper and lower connection structures 102, 104, and roller 106. Each assembly 90 is designed to be secured to a corresponding inboard stanchion 38*b* in a standoff fashion through the medium of the connection structures 102, 104; accordingly, the assemblies 90 can be retrofitted to the dock 88. Again, while the illustrated assemblies 90,92 are principally intended for after market use, the principles of the present invention are applicable where the assemblies 90,92 are installed onto the dock 88 as original equipment.

The bearings 96, 98, and 100 are substantially identical with the previously described bearings 70, 72, and 74, in that each of these components is formed of corresponding halves 96*a,* 96*b,* 98*a,* 98*b,* and 100*a,* 100*b,* and these components are secured to upright 94 by means of fasteners 108, 110, and 112. In like manner, the roller 106 is made up of halves 106*a,* 106*b* equipped with mating dovetail joint structure 108.

The connection structures 102, 104 are preferably identical, and each includes a two-part clamp fixture 114 including a clamping segment 116 and a mating connection segment 118, interconnected by means of fasteners 120. However, it is also consistent with the principles of the present invention where the assemblies 90,92 includes connection structures 102,104 that are not identically shaped or configured. Furthermore, it is within the ambit of the present invention where only one of the connection structures 102,104 is used or where more than two of the structures 102,104 are incorporated into the corresponding assembly 90,92.

The segment 118 includes a tubular female end portion 122 as well as an inboard apertured wall 124. Additionally, a male tubular coupler 126 having an apertured outer end wall 127 is secured to the upright 94 and is sized to telescope within the portion 122. While the illustrated coupler 126 is preferably fixed to the upright 94 (e.g., by welding), it is also within the ambit of the present invention where the coupler 126 is releasably attached to the upright 94. Connection between the portion 122 and coupler 126 is provided by means of bolt and nut assembly 128 extending through the apertures in walls 124 and 127. In order to provide a degree of resilient bias, a coil spring 130 is disposed about bolt and nut assembly 128 and is captively retained between the walls 124 and 127. The spring 120 is compressed between the walls 124, 127. Again, further details concerning the bumper assemblies 90,92 are described in the above-referenced copending U.S. Application.

The roller halves 106*a*, 106*b* are assembled onto the corresponding upright 94 by arranging one of the halves 106*a*, 106*b* in a position extending between the couplers 126, with the joint structure being spaced laterally from the couplers 126. Thus, as the halves 106*a*, 106*b* are slid into engagement, the couplers 126 do not interfere with sliding movement of the other of the halves 106*a*, 106*b*.

The corner-mounted bumper assemblies 92 are in most respects identical with the assemblies 90 and, therefore, like reference numerals are employed to indicate similar components. However, the clamping fixtures 114*a* of the assemblies 92 are somewhat different from fixtures 114. In particular, the clamping segments 114*a* are interconnected by means of metallic angle piece 132 which is configured to complementally mate with two sides of an inboard stanchion 38*b*, and each of the segments 114*a* has a pair of outwardly extending, apertured ears. Also, the clamping segments 116*a* are designed to mate with the opposed surfaces of stanchion 38*b*, as illustrated, and fasteners 120*a* are used to connect the segments 114*a*, 116*a*. An auxiliary clamp 134 is provided between the fixtures 114*a* to further strengthen the overall assembly 92.

The bumper assemblies 90, 92 operate in much the same manner as assemblies 30, 68, in that the associated rollers rotate about upright axes when struck by a boat. However, the assemblies 90, 92 have an additional functionality owing to the construction of the presence of the interfitted portions 122 and couplers 126, and spring 130. As will be readily appreciated from consideration of FIG. 15, when a boat strikes one of the bumpers 90 or 92, the coupler 126 is displaced inwardly relative to portion 122, which further compresses biasing spring 130. This absorbs an essential part of the engagement load, and also serves to return the bumper 90, 92 to its original position after operation thereof.

In preferred forms, the rollers 58, 76, and 106 are formed of a synthetic resin material such as ultrahigh molecular weight polyurethane. If desired, a phosphorescent material may be embedded into the polyurethane to increase the visibility of the rollers. The rollers typically have a diameter of about 2-10 inches, and a length of about 3-10 feet.

While the invention has been illustrated in the context of floating docks, it will be appreciated that the invention may be utilized with a wide variety of other mooring structures or boat securements, such as stationary pier-supported docks or the like.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A boat mooring assembly comprising:

a frame including a side section that defines a boat slip;

a plurality of upright stanchions spaced along the length of the side section;

roof structure supported by said stanchions; and a boat bumper mounted on one of said stanchions, said boat bumper including an elongated roller that surrounds and is rotatable about the one of said stanchions, said boat bumper including a pair of vertically spaced apart end bearings secured to the one of said stanchions, said roller being rotatably supported by said end bearings.

2. The assembly as claimed in claim 1, said frame presenting a predetermined water line, said stanchions and said roller extending upwardly from a point below the water line.

3. The assembly as claimed in claim 2, said roller having a length of at least about three feet.

4. The assembly as claimed in claim 2; and a buoyant base, said frame being secured to the buoyant base.

5. The assembly as claimed in claim 4, said frame including a bottom plate segment attached to the one of the stanchions, said bottom plate segment supporting the one of the stanchions, with the stanchion projecting upwardly therefrom.

6. The assembly as claimed in claim 1, each of said end bearings having a radially outermost flange positioned axially outside the roller and an inner bearing-defining projection extending axially from the flange and being rotatably received within the roller.

7. The assembly as claimed in claim 1, said end bearings each comprising a pair of mated bearing sections.

8. The assembly as claimed in claim 1, each of said end bearings secured to the one of said stanchions by a threaded fastener.

9. The assembly as claimed in claim 1, said boat bumper including an intermediate bearing secured to the one of said stanchions between said end bearings.

10. The assembly as claimed in claim 1, said end bearings being fixed onto the one of the stanchions, said end bearings each presenting a journal bearing surface onto which the roller is slidably received.

11. The assembly as claimed in claim 10, said upright presenting a substantially polygonal cross-sectional shape, said end bearings each including a complementally-shaped passageway for receiving the upright so as to prevent relative rotation therebetween.

12. A boat mooring assembly comprising:

a frame including a side section that defines a boat slip;

a plurality of upright stanchions spaced along the length of the side section;

roof structure supported by said stanchions; and a boat bumper mounted on one of said stanchions, said boat bumper including an elongated roller that surrounds and is rotatable about the one of said stanchions, said roller comprising a pair of mated roller sections.

13. The assembly as claimed in claim 12, said mated roller sections having complemental dovetail joint structure configured to interlock said roller sections.

14. The assembly as claimed in claim 12,
said boat slip being substantially rectangular,
said frame including a plurality of interconnected side sections that define the boat slip.

15. A boat mooring assembly comprising:
a frame including a side section that defines a boat slip;
a plurality of upright stanchions spaced along the length of the side section;
roof structure supported by said stanchions;
a boat bumper mounted on one of said stanchions,
said boat bumper including an elongated roller that surrounds and is rotatable about the one of said stanchions,
said frame presenting a predetermined water line,
said stanchions and said roller extending upwardly from a point below the water line; and
a buoyant base,
said frame being secured to the buoyant base,
said frame including a bottom plate segment attached to the one of the stanchions,
said bottom plate segment supporting the one of the stanchions, with the stanchion projecting upwardly therefrom,
said frame including an upright concavo-convex plate segment attached to the bottom plate.

16. The assembly as claimed in claim 15,
said concavo-convex plate presenting a recess for partly receiving the roller therein.

17. A retrofit boat bumper operable to be mounted on an upright of a boat mooring assembly, said bumper comprising:
a pair of end bearings operable to be mounted on said upright at spaced apart locations,
said end bearings comprising a plurality of mated end bearing components; and
a roller rotatably mounted on said end bearings and thereby configured to surround and rotate about the upright,
said roller including a plurality of mated roller sections.

18. The retrofit boat bumper as claimed in claim 17; and
an intermediate bearing operable to be mounted on said upright between said end bearings,
said intermediate bearing comprising a plurality of mated intermediate bearing components.

19. The retrofit boat bumper as claimed in claim 17,
said end bearings each comprising a pair of mated end bearing components.

20. The retrofit boat bumper as claimed in claim 17,
said roller comprising a pair of mated roller sections.

21. The retrofit boat bumper as claimed in claim 20,
said mated roller sections having complemental dovetail joint structure configured to interlock said roller sections.

22. The retrofit boat bumper as claimed in claim 17,
each of said end bearings having a radially outermost flange positioned axially outside the roller and an inner bearing-defining projection extending axially from the flange and being rotatably received within the roller.

23. The retrofit boat bumper as claimed in claim 17; and
threaded fasteners for securing said end bearings to said upright.

24. The retrofit boat bumper as claimed in claim 17,
said end bearings configured to be fixed onto the upright,
said end bearings each presenting a journal bearing surface onto which the roller is slidably received.

25. The retrofit boat bumper as claimed in claim 24,
said end bearings each including a polygonal-shaped passageway configured to receive the upright so as to prevent relative rotation therebetween.

26. The retrofit boat bumper as claimed in claim 17,
said roller having a length of at least about three feet.

27. A boat bumper assembly operable to be used on a boat mooring assembly, wherein the boat mooring assembly includes a frame with a side section that defines a boat slip, the boat mooring assembly further including a plurality of uprights spaced along the length of said side section, wherein the boat bumper assembly is operable to be mounted on one of said uprights, said boat bumper assembly comprising:
an upright support member;
a pair of end bearings mounted on said member at spaced apart locations,
each of said end bearings comprising a plurality of mated end bearing components;
a roller rotatably mounted on said end bearings,
said roller including a plurality of mated roller sections; and
a cushioning connector operable to secure said support member to a corresponding upright.

28. The assembly as claimed in claim 27,
said connector permitting said roller to shift when engaged by a boat.

29. The assembly as claimed in claim 27,
said bumper assembly including an intermediate bearing mounted on said member between said end bearings,
said intermediate bearing comprising a plurality of mated intermediate bearing components.

30. The assembly as claimed in claim 27,
said end bearings each comprising a pair of mated end bearing components.

31. The assembly as claimed in claim 27,
said roller comprising a pair of mated roller sections.

32. The assembly as claimed in claim 31,
said mated roller sections including complemental dovetail joint structure configured to interlock said roller sections.

33. The assembly as claimed in claim 27,
each of said end bearings having a radially outermost flange positioned axially outside the roller and an inner bearing-defining projection extending axially from the flange and being rotatably received within the roller.

34. The assembly as claimed in claim 27,
said bumper assembly including threaded fasteners for securing said end bearings to said member.

35. The retrofit boat bumper as claimed in claim 27,
said end bearings configured to be fixed onto one of the uprights,
said end bearings each presenting a journal bearing surface onto which the roller is slidably received.

36. The retrofit boat bumper as claimed in claim 35,
said end bearings each including a polygonal-shaped passageway configured to receive the one of the uprights so as to prevent relative rotation therebetween.

37. The assembly as claimed in claim 27,
said roller having a length of at least about three feet.

38. The boat bumper as claimed in claim 27,
said cushioning connector being operable to urge the support member relative to the corresponding upright so that the boat bumper is located in a neutral position and to permit lateral shifting of the support member from the neutral position in response to contact by the boat.

39. The boat bumper as claimed in claim 38; and
a second cushioning connector,
said connectors being operable to absorb forces applied when the boat contacts the roller,
at least a portion of said connectors being linearly shiftable from the neutral position to permit lateral translational movement of the support member while substantially restricting pivotal movement thereof.

40. The boat bumper as claimed in claim 38, said cushioning connector including a spring that yieldably biases the support member into the neutral position, said connector permitting the support member to be displaced from the neutral position when the roller is contacted by the boat and returned to the neutral position thereafter.

41. The boat bumper as claimed in claim 40, said cushioning connector including portions, with one portion being fixed to the support member and another portion configured to be fixed to the upright, said portions being telescopically interfitted.

42. The boat bumper as claimed in claim 41, said portions each receiving the spring and securing the spring within the mechanism.

43. A boat bumper assembly operable to be used on a boat mooring assembly, wherein the boat mooring assembly includes a frame with a side section that defines a boat slip, the boat mooring assembly further including a plurality of uprights spaced along the length of said side section, wherein the boat bumper assembly is operable to be mounted on one of said uprights, said boat bumper assembly comprising:

an upright support member;

a pair of end bearings fixed to said member at spaced apart locations with journal bearing surfaces spaced from the member;

a roller rotatably received on said journal bearing surfaces, said roller surrounding and being rotatable about the member and the pair of end bearings; and a cushioning connector operable to secure said support member to a corresponding upright.

* * * * *